US007507319B2

(12) United States Patent
Kuriyama et al.

(10) Patent No.: US 7,507,319 B2
(45) Date of Patent: Mar. 24, 2009

(54) ANODE HOLDER

(75) Inventors: Fumio Kuriyama, Tokyo (JP); Masaaki Kimura, Tokyo (JP)

(73) Assignee: Ebara Corporation, Tokyo (JP)

( * ) Notice: Subject to any disclaimer, the term of this patent is extended or adjusted under 35 U.S.C. 154(b) by 59 days.

(21) Appl. No.: 11/490,131

(22) Filed: Jul. 21, 2006

(65) Prior Publication Data

US 2008/0017505 A1 Jan. 24, 2008

(51) Int. Cl.
*C25B 9/02* (2006.01)

(52) U.S. Cl. ..... 204/288.4; 204/286.1; 204/288.1; 204/288.3; 204/297.01; 204/297.06; 204/297.13; 204/297.14; 204/297.15

(58) Field of Classification Search ..... 204/279, 204/286.1, 288.1, 288.3, 288.4, 297.01, 297.06, 204/297.14, 297.15, 297.13
See application file for complete search history.

(56) References Cited

U.S. PATENT DOCUMENTS 4,149,956 A * 4/1979 Bess et al. ..... 204/284
4,397,728 A * 8/1983 Pfister et al. ..... 204/244
6,365,020 B1 4/2002 Yoshioka et al.
6,716,332 B1 4/2004 Yoshioka et al.

* cited by examiner

*Primary Examiner*—Bruce F Bell
(74) *Attorney, Agent, or Firm*—Wenderoth, Lind & Ponack, L.L.P.

(57) ABSTRACT

An anode holder is used to hold an anode in a plating tank. The anode holder includes a bar having a conductive portion connected to a power source, a conductive anode shaft attached to the bar, and an anode connected to the conductive anode shaft. The conductive anode shaft includes an external thread portion provided at an end of the conductive anode shaft, an O-ring, and a step portion provided between the O-ring and the external thread portion. The step portion has a diameter larger than a diameter of the external thread portion but smaller than a diameter of the O-ring. The anode includes an internal thread hole to which the external thread portion of the conductive anode shaft is screwed. The anode also includes a receiving portion for receiving the step portion of the conductive anode shaft in a state such that the O-ring of the conductive anode shaft is brought into contact with an inner surface of the receiving portion.

16 Claims, 8 Drawing Sheets

ANODE HOLDER

BACKGROUND OF THE INVENTION

1. Field of the Invention

The present invention relates to an anode holder, and more particularly to an anode holder for holding an anode in a plating tank used for forming a metal film or an interconnection on a large-scale integrated circuit (LSI) substrate.

2. Description of the Related Art

Recently, a plating process has been employed to form metal films, organic films, interconnections, or bumps (protruding connecting electrode terminals) for semiconductor circuits in a substrate such as a silicon wafer. For example, it has widely been practiced to form bumps of gold, silver, copper, solder, nickel, or multi-layer materials of these metals at predetermined portions on a surface of a semiconductor wafer, which has semiconductor circuits and fine interconnections between the semiconductor circuits, to electrically connect the interconnections via the bumps to electrodes of a package substrate or to tape automated bonding (TAB) electrodes.

Methods of forming interconnections or bumps include various methods, such as electroplating, electroless plating, vapor deposition, and printing. According to a recent tendency to an increased number of I/O terminals in a semiconductor chip and to finer pitches between interconnections, an electroplating method has been employed more frequently because of its capability of fine processing and a high deposition rate. The electroplating method, which is one of the most popular methods of forming interconnections or bumps, can form a metal film having a high purity at a high deposition rate by a relatively simple control.

In an electroplating method, a voltage is applied between an anode and a substrate to form a metal film on a surface of the substrate. The anode serves as an anode terminal for generating an electric current for the plating. The anode is dissolved in a plating solution to supply metal ions into the plating solution in proportion to the amount of plating. Thus, the anode is worn in proportion to the amount of plating. Accordingly, it is necessary to replace anodes periodically.

A conductive portion connecting between an anode and a power source should have a high electric conductivity because such a conductive portion supplies an electric current to the anode for the electroplating. Further, it is important to maintain a sufficient electric connection at a connecting portion between the conductive portion and the anode. Furthermore, it is desirable that the conductive portion connecting between the anode and the power source has a corrosion resistance because the anode is immersed in a plating solution.

SUMMARY OF THE INVENTION

The present invention has been made in view of the above drawbacks. It is, therefore, an object of the present invention to provide an anode holder which can maintain a corrosion resistance of a conductive portion between an anode and a power source and provide a good electrical connection between the conductive portion and the anode.

According to a first aspect of the present invention, there is provided an anode holder which can maintain a corrosion resistance of a conductive portion between an anode and a power source and provide a good electrical connection between the conductive portion and the anode. The anode holder is used to hold an anode in a plating tank. The anode holder includes a bar having a conductive portion connected to a power source, a conductive anode shaft attached to the bar, and an anode connected to the conductive anode shaft. The conductive anode shaft includes an external thread portion provided at an end of the conductive anode shaft, an O-ring, and a step portion provided between the O-ring and the external thread portion. The step portion has a diameter larger than a diameter of the external thread portion but smaller than a diameter of the O-ring. The anode includes an internal thread hole to which the external thread portion of the conductive anode shaft is screwed. The anode also includes a receiving portion for receiving the step portion of the conductive anode shaft in a state such that the O-ring of the conductive anode shaft is brought into contact with an inner surface of the receiving portion.

According to a second aspect of the present invention, there is provided an anode which can maintain a corrosion resistance of a conductive portion between the anode and a power source and provide a good electrical connection between the conductive portion and the anode. The anode is held in a plating tank by an anode holder. The anode includes an internal thread hole to which an external thread portion provided at an end of a conductive anode shaft is screwed. The anode also includes a receiving portion for receiving a step portion of the conductive anode shaft between the external thread portion and an O-ring of the conductive anode shaft in a state such that the O-ring is brought into contact with an inner surface of the receiving portion. The step portion has a diameter larger than a diameter of the external thread portion but smaller than a diameter of the O-ring.

According to a third aspect of the present invention, there is provided a conductive anode shaft which can maintain a corrosion resistance of a conductive portion between an anode and a power source and provide a good electrical connection between the conductive portion and the anode. The conductive anode shaft connects an anode held in a plating tank and a bar connected to a power source. The conductive anode shaft includes an external thread portion provided at an end of the conductive anode shaft. The external thread portion is screwed to an internal thread hole formed in an anode. The conductive anode shaft also includes an O-ring and a step portion provided between the O-ring and the external thread portion. The step portion has a diameter larger than a diameter of the external thread portion but smaller than a diameter of the O-ring. The step portion is received in a receiving portion formed in the anode in a state such that the O-ring is brought into contact with an inner surface of the receiving portion.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

Figure 1:
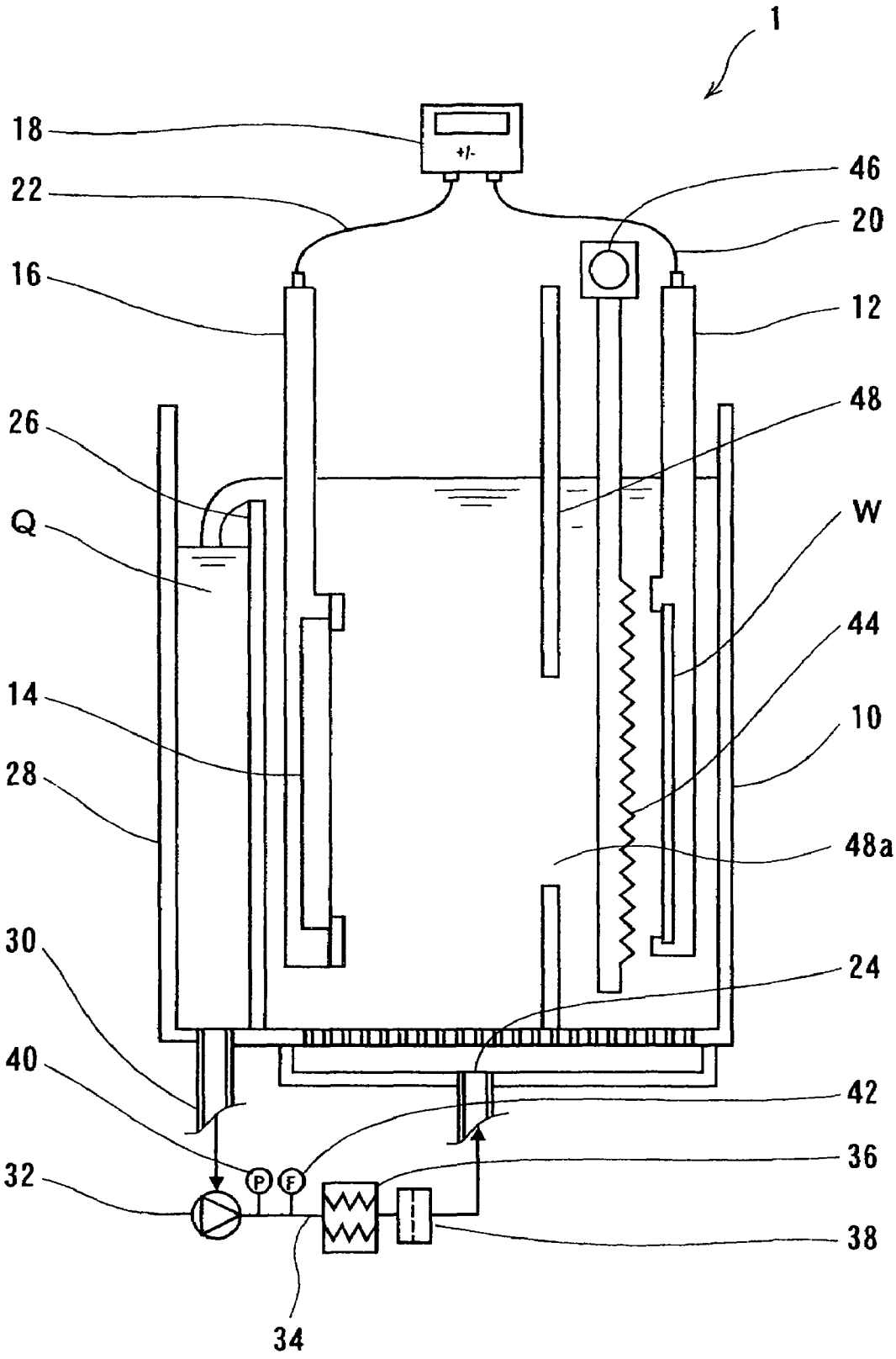
FIG. 1 is a schematic view showing a plating apparatus having an anode holder according to an embodiment of the present invention.

A plating apparatus having an anode holder according to an embodiment of the present invention will be described below with reference to FIGS. 1 through 8. Like or corresponding parts are denoted by like or corresponding reference numerals throughout the drawings, and will not be described below repetitively.

FIG. 1 is a schematic view showing a plating apparatus 1 having an anode holder according to an embodiment of the present invention. As shown in FIG. 1, the plating apparatus 1 has a plating tank 10 for holding a plating solution Q therein, a substrate holder 12 for holding a substrate W, an anode holder 16 for holding an anode 14, and a plating power source 18. The anode 14 is disposed in the anode holder 16 so as to face the substrate W.

The substrate W and the anode 14 are disposed in a vertical direction and immersed in the plating solution Q held by the plating tank 10. The substrate W and the anode 14 are disposed in parallel to each other so that a surface of the substrate W to be plated faces the anode 14. The substrate W is connected via a lead 20 to a cathode of the plating power source 18, and the anode 14 is connected to a lead 22 to an anode of the plating power source 18.

The plating tank 10 has a plating solution supply inlet 24 provided on a bottom of the plating tank 10 for supplying a plating solution Q to the plating tank 10. A portion of the plating solution Q overflows an overflow weir 26 into an overflow tank 28. The plating solution Q in the overflow tank 28 is discharged from a plating solution discharge port 30, which is provided on a bottom of the overflow tank 28. The plating solution discharged from the plating solution discharge port 30 is circulated by the circulation pump 32. The plating solution discharge port 30 is connected via a plating solution circulation line 34 to the plating solution supply inlet 24. The plating solution circulation line 34 has a thermostat 36, a filter 38, a pressure gauge 40, and a flowmeter 42 provided thereon.

The plating apparatus 1 has an agitation paddle 44 disposed in a vertical direction between the substrate W and the anode 14. The agitation paddle 44 has an upper end attached to a paddle shaft 46. When the paddle shaft 46 is moved, the agitation paddle 44 is moved in parallel to the substrate W to agitate the plating solution Q in the plating tank 10.

When a voltage is applied between the substrate W and the anode 14 by the plating power source 18, metal ions in the plating solution Q receive electrons from a surface of the substrate W because of a potential difference produced between the substrate W and the anode 14. Thus, metal is deposited on the surface of the substrate W to form a metal film on the surface of the substrate W. Further, because of the potential difference produced between the substrate W and the anode 14, electrons are released from the anode 14, ionized, and dissolved in the plating solution Q. The thickness of the anode 14 is reduced as the anode 14 is dissolved in the plating solution Q.

The plating apparatus 1 has a regulation plate 48 disposed between the substrate W and the anode 14. The regulation plate 48 has a hole 48*a* formed at a central portion thereof. The regulation plate 48 serves to adjust a potential distribution in the plating tank 10.

Figure 2:
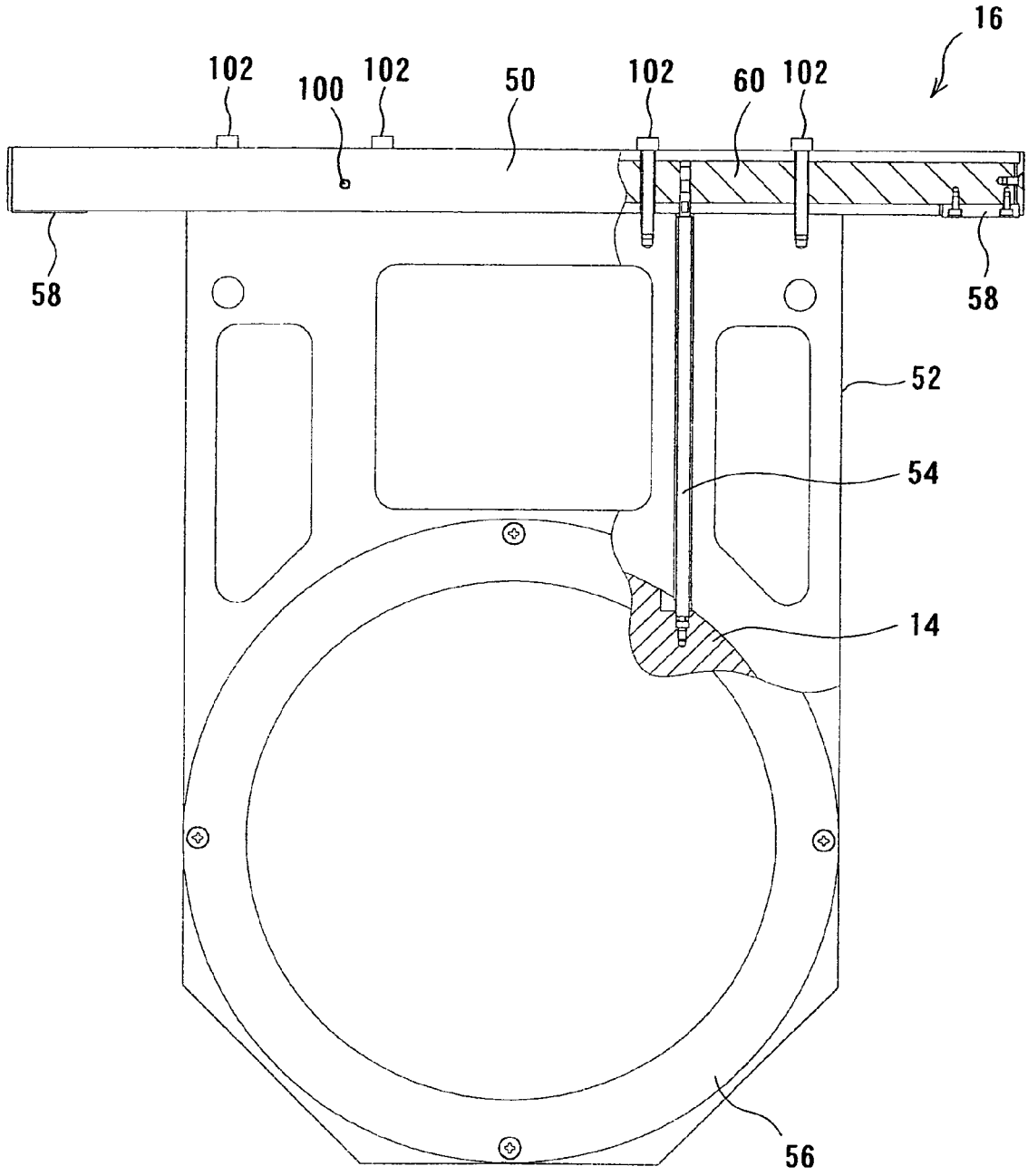
FIG. 2 is a front view of the anode holder shown in FIG. 1.
Figure 3:
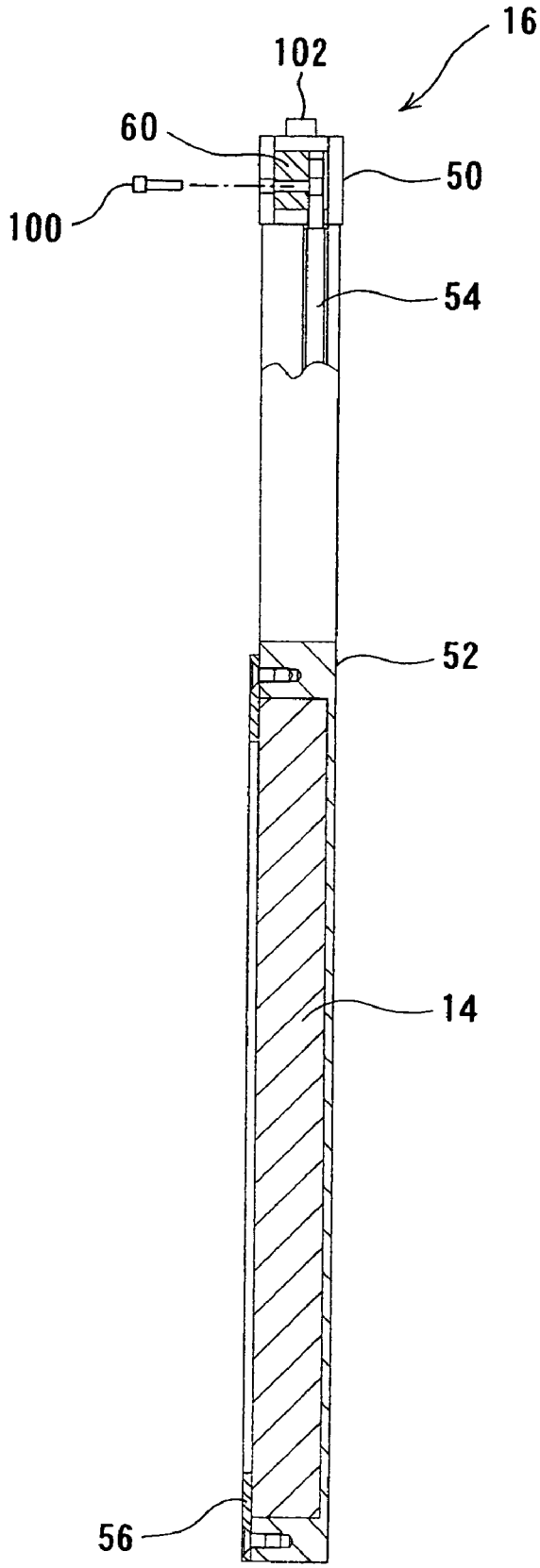
FIG. 3 is a vertical cross-sectional view of FIG. 2.

FIG. 2 is a front view of the anode holder 16 shown in FIG. 1, and FIG. 3 is a vertical cross-sectional view of FIG. 2. As shown in FIGS. 2 and 3, the anode holder 16 has a bar 50 placed on bar stages (not shown) of the plating tank 10, a support member 52 extending downward from the bar 50, two conductive anode shafts 54 connecting between an inner conductive portion 60 of the bar 50 and the anode 14, and an anode mask 56 covering a peripheral portion of the anode 14. The support member 52 supports the anode 14. The anode mask 56 serves to adjust a diameter of an area at which the anode 14 contacts the plating solution Q. In FIG. 2, only one of the anode shafts 54 is illustrated.

Contacts 58 are attached to lower surfaces of both ends of the bar 50. The contacts 58 are brought into contact with contact plates (not shown) provided on upper surface of the bar stages of the plating tank 10. The contact plates are connected to the plating power source 18 (see FIG. 1). For example, the contacts 58 may be formed of a stainless plate plated with gold. The bar 50 has the inner conductive portion 60 made of copper. The conductive portion 60 is electrically connected to the contacts 58. The anode shafts 54 are connected to the conductive portion 60. Thus, a current is supplied from the plating power source 18 through the conductive portion 60 in the bar 50 and the conductive anode shafts 54 to the anode 14.

Figure 4:
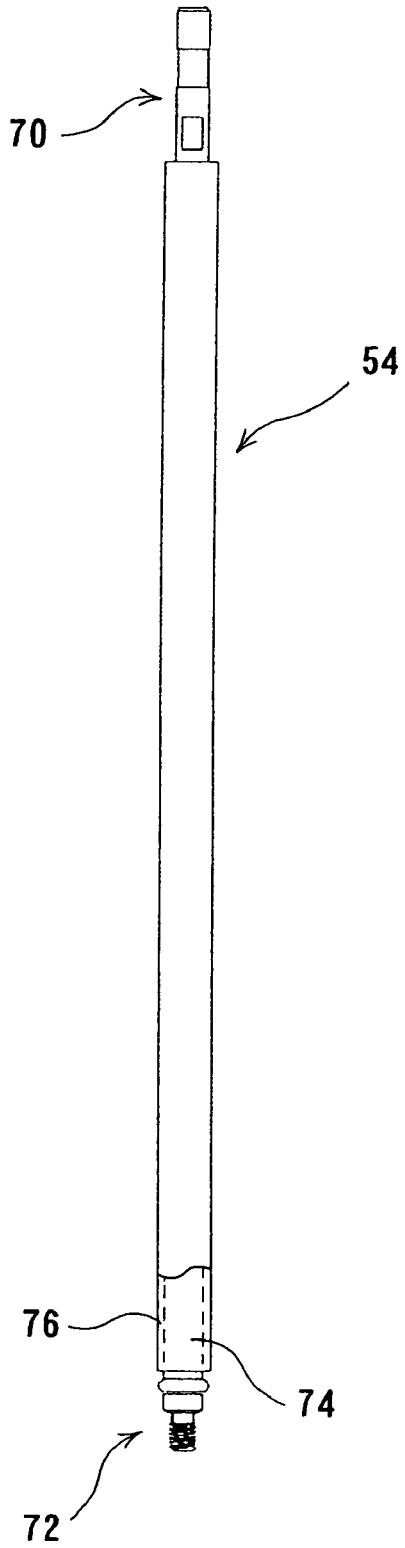
FIG. 4 is a front view showing an anode shaft in the anode holder shown in FIG. 2.

FIG. 4 is a front view showing one of the anode shafts 54. As shown in FIG. 4, the anode shaft 54 has an upper connecting portion 70 connected to the conductive portion 60 of the bar 50 and a lower connecting portion 72 connected to the anode 14. It is desirable that the anode shaft 54 has a corrosion resistance because it extends through both of the plating solution and an atmosphere. Accordingly, in the present embodiment, the anode shaft 54 includes a conductive core 74 and a tube 76 covering the core 74. The core 74 is made of oxygen-free copper or titanium, and the tube 76 is made of an insulating material. It is desirable that the tube 76 is made of a material having a chemical resistance, such as polyethylene (PE), polypropylene (PP), or polytetrafluoroethylene (PTFE).

Figure 5:
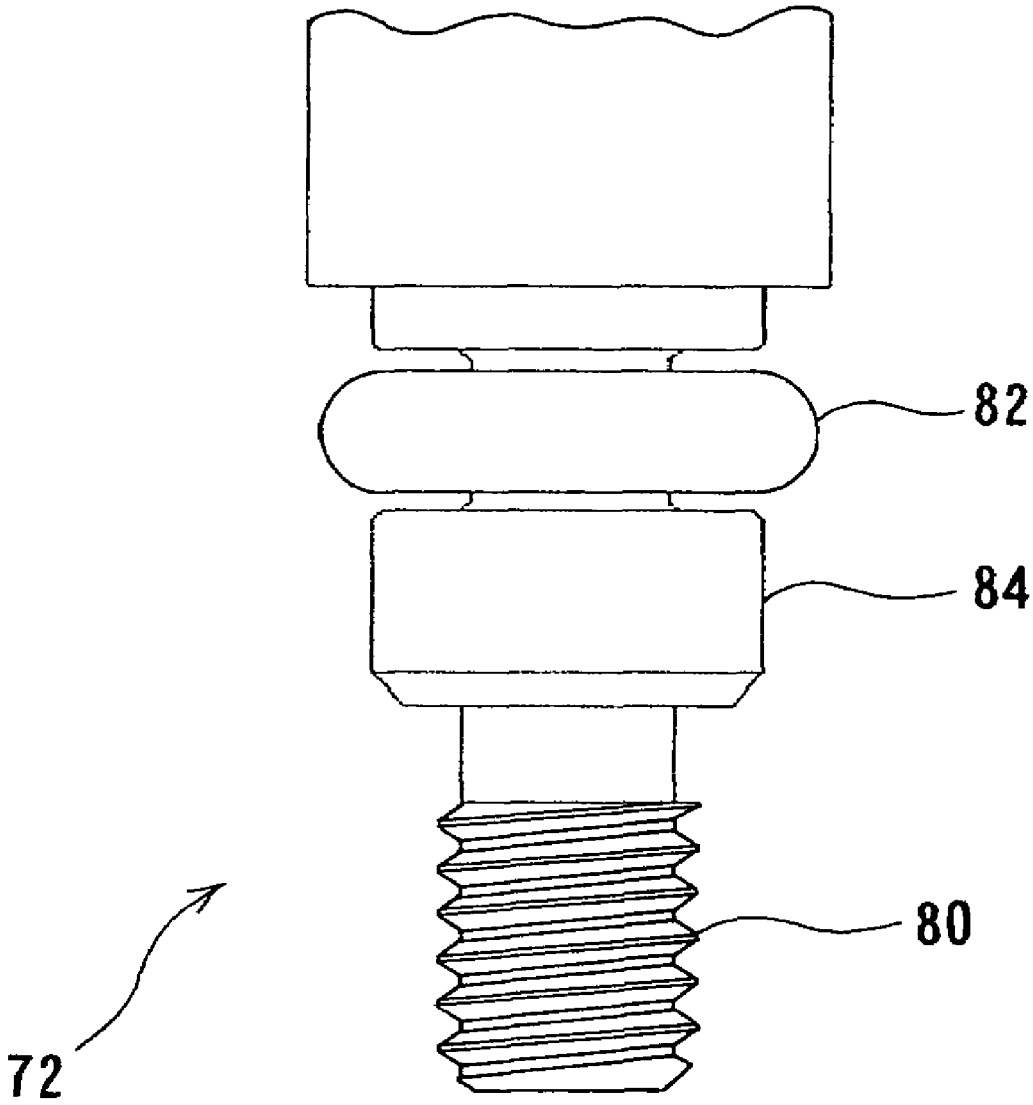
FIG. 5 is an enlarged view showing a connecting portion of the anode shaft shown in FIG. 4.

FIG. 5 is an enlarged view of the lower connecting portion 72. As shown in FIG. 5, the lower connecting portion 72 includes an external thread portion 80 provided on an end of the lower connecting portion 72, an O-ring 82, and a step (shoulder) portion 84 provided between the O-ring 82 and the external thread portion 80. The step portion 84 has a diameter larger than that of the external thread portion 80 but smaller than that of the O-ring 82.

Figure 6:
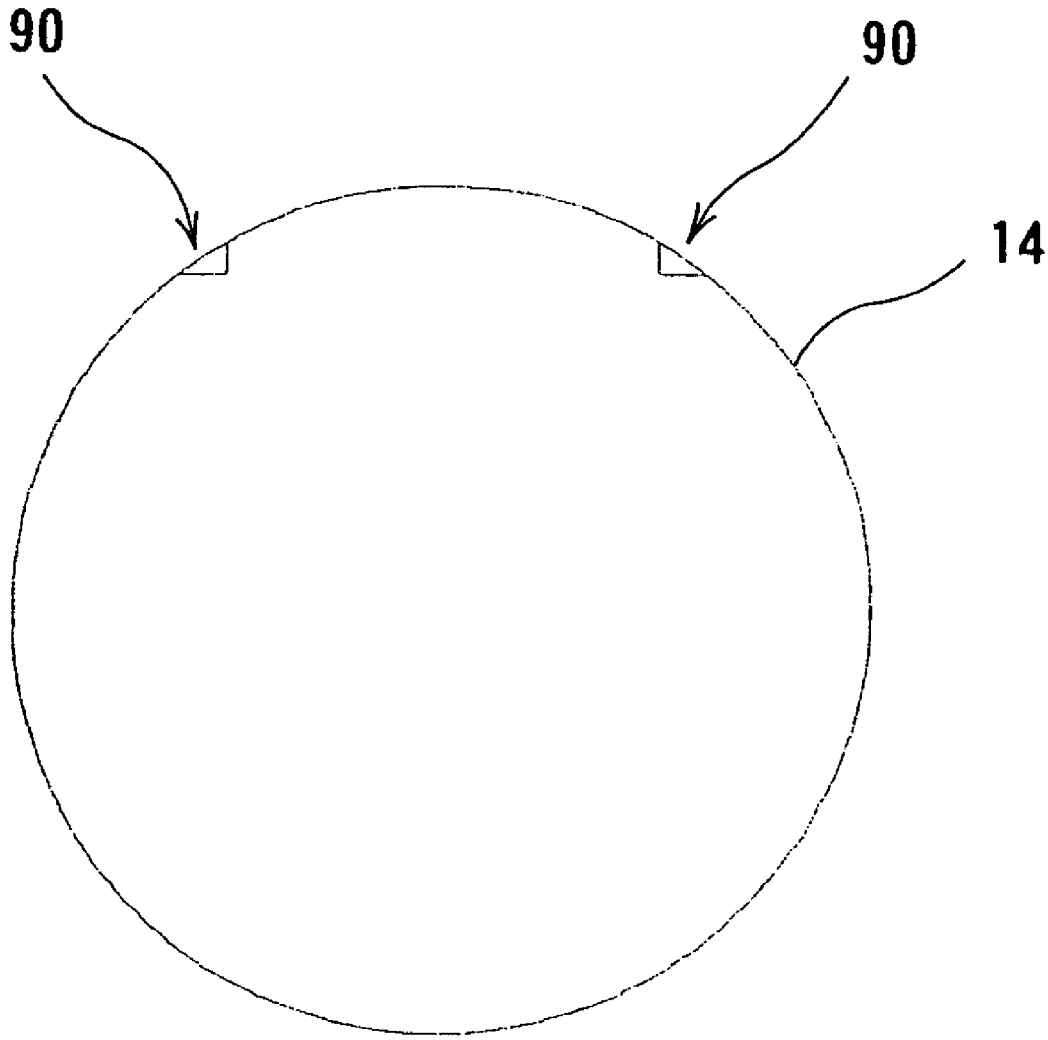
FIG. 6 is a front view showing an anode in the anode holder shown in FIG. 2.

FIG. 6 is a front view showing the anode 14. For example, the anode 14 is made of copper containing phosphorus of 0.1% or less and formed of a circular disk having a thickness of 5 mm to 50 mm. Such an anode 14 can provide favorable dissolution and favorable supply of ions. As shown in FIG. 6, the anode 14 has two connecting portions 90 provided at upper portions thereof. The aforementioned anode shafts 54 are connected to the connecting portions 90 of the anode 14.

Figure 7:
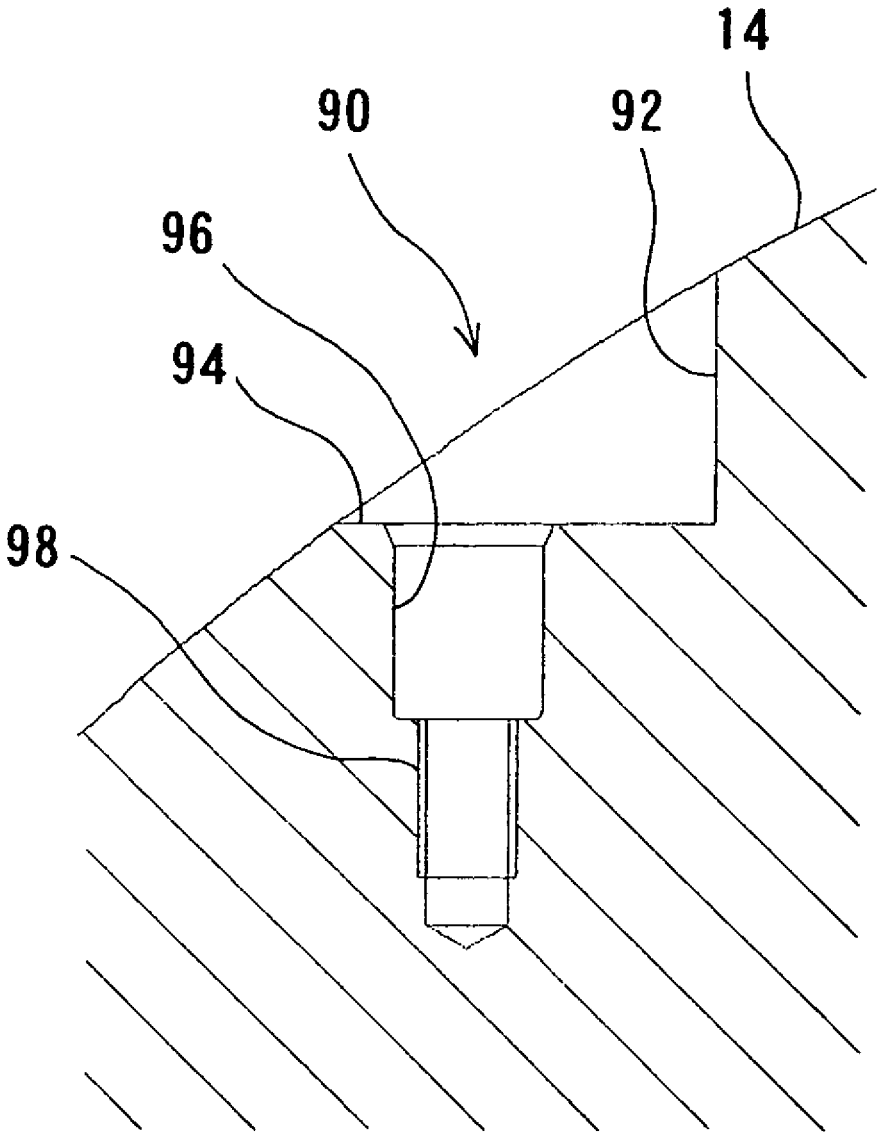
FIG. 7 is an enlarged cross-sectional view showing a connecting portion of the anode shown in FIG. 6.

FIG. 7 is an enlarged cross-sectional view of the connecting portion 90 of the anode 14. As shown in FIG. 7, the connecting portion 90 has a first cut surface 92 extending in an axial direction of the anode shaft 54 and a second cut surface 94 extending in a direction perpendicular to the axis of the anode shaft 54. A receiving portion 96 is formed in the second cut surface 94 so as to extend in the axial direction of the anode shaft 54. The receiving portion 96 receives the step (shoulder) portion 84 of the anode shaft 54. An internal thread hole 98 is formed in a bottom of the receiving portion 96 so as to correspond to the external thread portion 80 of the anode shaft 54. The external thread portion 80 of the anode shaft 54 is screwed to the internal thread hole 98 to connect the anode shaft and the anode to each other.

Figure 8:
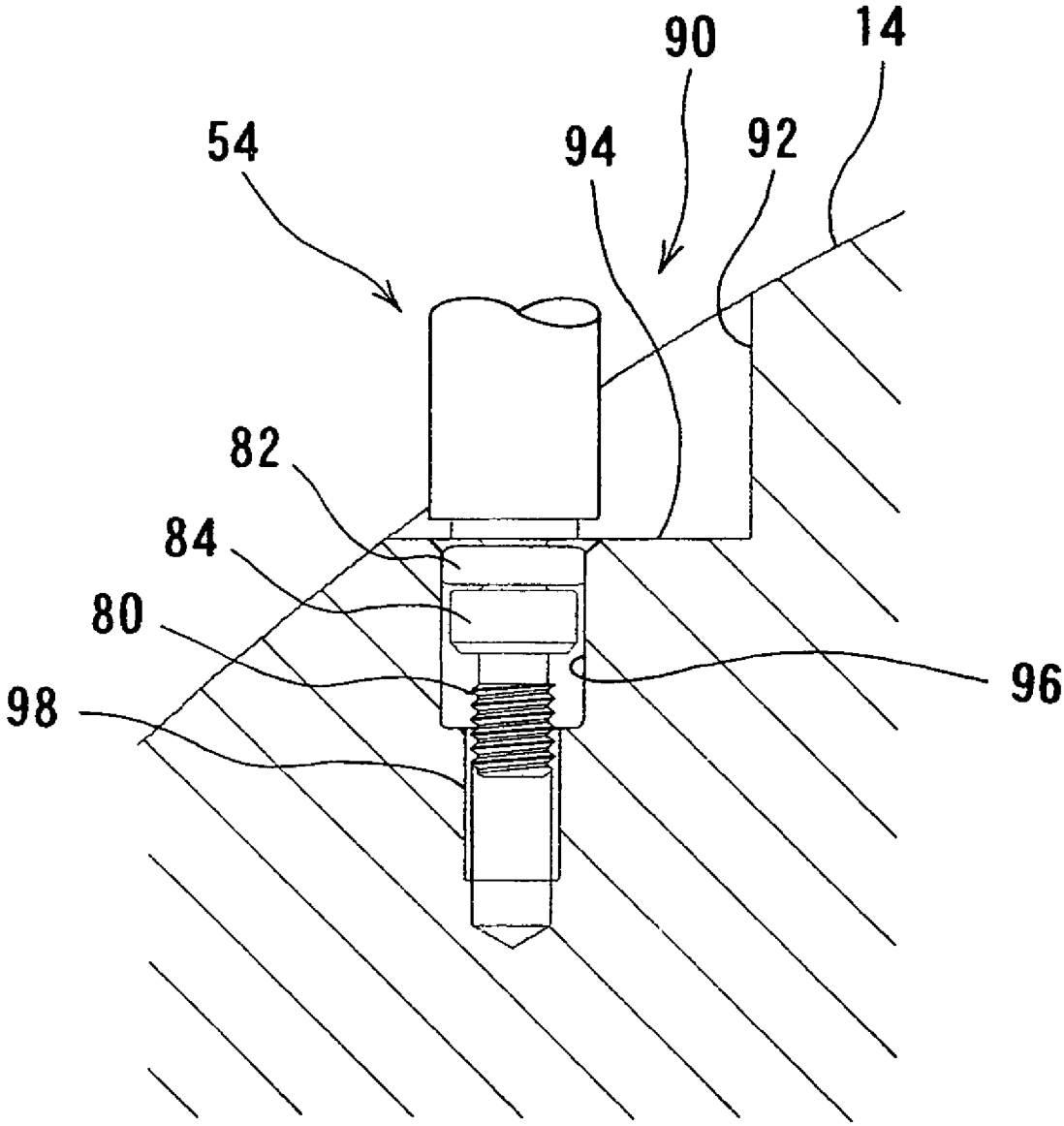
FIG. 8 is a view showing the connecting portion of the anode shown in FIG. 6 together with the anode shaft shown in FIG. 5.

FIG. 8 shows the connecting portion 90 of the anode 14 when the anode shaft 54 is connected to the connecting portion 90 of the anode 14. As shown in FIG. 8, the external thread portion 80 of the anode shaft 54 is screwed to the internal thread hole 98 of the anode 14 so that the step portion 84 of the anode shaft 54 is received in the receiving portion 96 of the anode 14. At that time, an outer circumferential surface of the O-ring 82 of the anode shaft 54 is brought into contact with an inner circumferential surface of the receiving portion 96.

Thus, the external thread portion 80 of the anode shaft 54 and the internal thread hole 98 of the anode 14 are connected to each other in a state such that the connecting portion between the anode shaft 54 and the anode 14 is sealed by the O-ring 82. Accordingly, it is possible to maintain a sufficient electric connection between the internal thread hole 98 of the anode 14 and the external thread portion 80 of the anode shaft 54. Further, it is possible to improve a corrosion resistance of the connecting portion between the anode 14 and the anode shaft 54. Furthermore, the anode 14 and the anode shaft 54 are connected to each other by simply screwing the external thread portion 80 to the internal thread hole 98. Accordingly, a worn anode 14 can readily be removed from the anode holder 16, and a new anode can readily be attached to the anode holder 16.

The anode 14 is removed from the anode holder 16 in the following manner. First, each of set bolts 100, which is used to fix an upper portion of the anode shaft 54 to the conductive portion 60 of the bar 50 and to electrically connect the anode shaft 54 to the conductive portion 60 of the bar 50, is detached from the bar 50. Then, fix bolts 102 are removed from the bar 50 to separate the bar 50 from the support member 52. Each of the anode shafts 54 is rotated and detached from the anode 14. Thereafter, the anode mask 56 is removed from the support member 52, and then the anode 14 is separated from the support member 52.

In the present embodiment, the anode holder 16 has two anode shafts 54, and the anode 14 has two connecting portions 90. However, the numbers of the anode shafts 54 and the connecting portions 90 are not limited to the illustrated example. For example, the anode holder 16 may have only one anode shaft 54, and the anode 14 may have only one connecting portion 90. Alternatively, the anode holder 16 may have three or more anode shafts 54, and the anode 14 may have three or more connecting portions 90.

Although certain preferred embodiments of the present invention have been shown and described in detail, it should be understood that various changes and modifications may be made therein without departing from the scope of the appended claims.

What is claimed is:

1. An anode assembly for use in a plating apparatus in which a substrate is to be disposed in a vertical orientation in a plating tank, said anode assembly comprising:

an anode held in a vertical orientation in the plating tank and parallel to the substrate such that a surface of the substrate to be plated faces said anode; and an anode holder for holding said anode in the vertical orientation, said anode holder comprising:

a bar extending horizontally and having a conductive portion to be connected to a power source;

a support member extending vertically and downwardly from said bar and having a recess configured to accommodate and support said anode such that said anode is held in the vertical orientation; and a conductive anode shaft attached to said bar, said conductive anode shaft extending vertically and downwardly from said bar, said conductive anode shaft including:

an external thread portion provided at an end of said conductive anode shaft and connected to said anode;

an O-ring; and a shoulder portion between said O-ring and said external thread portion, said shoulder portion having a diameter larger than a diameter of said external thread portion and smaller than a diameter of said O-ring; and wherein said anode is arranged within said recess of said support member, and includes:

an internal threaded hole into which said external thread portion of said conductive anode shaft is screwed so as to connect said conductive anode shaft of said anode holder to said anode; and a receiving portion for receiving said shoulder portion of said conductive anode shaft such that said O-ring of said conductive anode shaft is brought into contact with an inner surface of said receiving portion.

2. The anode assembly of claim 1, wherein said conductive anode shaft further includes:

a conductive core; and a tube covering said conductive core, said tube being made of an insulating material.

3. The anode assembly of claim 2, wherein said conductive core is made of oxygen-free copper or titanium.

4. The anode assembly of claim 1, wherein said anode comprises a circular disk having a thickness in a range of 5 mm to 50 mm.

5. The anode assembly of claim 1, wherein said receiving portion of said anode is formed in a surface perpendicular to a longitudinal axis of said conductive anode shaft so as to extend in the direction of the longitudinal axis of said conductive anode shaft.

6. The anode assembly of claim 1, wherein said anode is made of copper containing phosphorus in an amount no greater than 0.1%.

7. The anode assembly of claim 1, further comprising an anode mask for covering a peripheral portion of said anode.

8. An anode holder for holding an anode for use in a plating apparatus in which a substrate and the anode are disposed in a vertical orientation and parallel to each other within a plating tank so that a surface of the substrate to be plated faces the anode, said anode holder comprising:

a bar extending horizontally and having a conductive portion to be connected to a power source;

a support member extending vertically and downwardly from said bar and having a recess configured to accommodate and support the anode such that the anode is held in the vertical orientation; and a conductive anode shaft attached to said bar, said conductive anode shaft extending vertically and downwardly from said bar, said conductive anode shaft including:

an external thread portion provided at an end of said conductive anode shaft and to be connected to the anode;

an O-ring; and a shoulder portion between said O-ring and said external thread portion, said shoulder portion having a diameter larger than a diameter of said external thread portion and smaller than a diameter of said O-ring.

9. The anode holder of claim 8, wherein said conductive anode shaft further includes:

a conductive core; and a tube covering said conductive core, said tube being made of an insulating material.

10. The anode holder of claim 9, wherein said conductive core is made of oxygen-free copper or titanium.

11. The anode holder of claim 8, further comprising an anode mask for covering a peripheral portion of said anode.

12. An anode to be held by said anode holder of claim 8, wherein said anode comprises a circular disk having a thickness in a range of 5 mm to 50 mm.

13. An anode to be held by said anode holder of claim 8, wherein said anode is made of copper containing phosphorus in an amount no greater than 0.1%.

14. An anode to be held by said anode holder of clam 8, wherein said anode has a connecting portion to which said conductive anode shaft of said anode holder is connected.

15. The anode of claim 14, wherein said connecting portion includes:

an internal threaded hole into which said external thread portion of said conductive anode shaft is screwed; and a receiving portion for receiving said shoulder portion of said conductive anode shaft such that said O-ring of said conductive anode shaft is brought into contact with an inner surface of said receiving portion.

16. An anode holder for holding an anode for use in a plating apparatus in which a substrate and the anode are disposed in a vertical orientation and parallel to each other within a plating tank so that a surface of the substrate to be plated faces the anode, said anode holder comprising:

a bar extending horizontally and having a conductive portion to be connected to a power source;

a support member extending vertically and downwardly from said bar and having a recess configured to accommodate and support the anode such that the anode is held in the vertical orientation;

an anode mask for covering a peripheral portion of the anode;

a conductive anode shaft attached to said bar, said conductive anode shaft extending vertically and downwardly from said bar, said conductive anode shaft including:

an external thread portion provided at an end of said conductive anode shaft and to be connected to the anode;

an O-ring;

a shoulder portion between said O-ring and said external thread portion, said should portion having a diameter of said external thread portion and smaller than a diameter of said O-ring.

* * * * *

UNITED STATES PATENT AND TRADEMARK OFFICE

CERTIFICATE OF CORRECTION

PATENT NO. : 7,507,319 B2
APPLICATION NO. : 11/490131
DATED : March 24, 2009
INVENTOR(S) : Fumio Kuriyama et al.

It is certified that error appears in the above-identified patent and that said Letters Patent is hereby corrected as shown below:

In column 8, line 21, claim 16, "should" should read --shoulder--; and after "diameter" insert --larger than a diameter--.

Signed and Sealed this

Eighteenth Day of August, 2009

David J. Kappos

David J. Kappos
*Director of the United States Patent and Trademark Office*